United States Patent [19]

Sakurai

[11] 3,980,292

[45] Sept. 14, 1976

[54] DEVICE FOR PARALLELY FEEDING OBJECTS TO BE PRINTED IN A PRINTING MACHINE

[75] Inventor: Yoshikuni Sakurai, Tokyo, Japan

[73] Assignee: Sakurai Seisakusho Co. Ltd., Japan

[22] Filed: Dec. 18, 1974

[21] Appl. No.: 533,943

[30] Foreign Application Priority Data

Aug. 23, 1974 Japan ..... 49-96091

[52] U.S. Cl. ..... 271/11; 271/93; 271/95; 271/107

[51] Int. Cl.[2] ..... B65H 3/08; B65H 3/10

[58] Field of Search ..... 271/91, 93, 90, 94, 271/95, 107, 30 R, 11, 12, 13, 14, 15, 276, 196; 214/8.5 D

[56] References Cited

UNITED STATES PATENTS

| | | | |
|---|---|---|---|
| 653,608 | 7/1900 | Barr | 271/196 X |
| 2,268,299 | 12/1941 | Pearson | 271/93 |
| 3,048,392 | 8/1962 | Spiess | 271/95 |
| 3,291,482 | 12/1966 | Stemmler | 271/94 X |

*Primary Examiner*—Evon C. Blunk
*Assistant Examiner*—Bruce H. Stoner, Jr.
*Attorney, Agent, or Firm*—Willis Bugbee

[57] ABSTRACT

A device for parallelly feeding objects to be printed in a printing machine, which device feeds substantially parallelly an object to be printed to the feed rollers by providing a vacuum feeding sucker and a rotary vacuum ring which is lifted in synchronism with the sucker.

2 Claims, 2 Drawing Figures

DEVICE FOR PARALLELY FEEDING OBJECTS TO BE PRINTED IN A PRINTING MACHINE

SUMMARY OF THE INVENTION

The present invention particularly resides in the provision of a device for parallelly feeding objects to be printed in a printing machine, which device feeds substantially parallelly an object to be printed to the feed rollers by providing in addition to a vacuum feeding sucker, a rotary vacuum ring means which is lifted in synchronism with the sucker.

BACKGROUND OF THE INVENTION

In the feeding of objects to be printed, such as a thick object like a print board, an aluminum sheet, a thin sheet of metal or other such object which is different from the usual paper sheet, such objects cannot be lifted at the rear end portion thereof only by a sucker which sucks the front end portion thereof so that the object to be printed cannot be fed parallelly to feed rollers.

Figure 1:
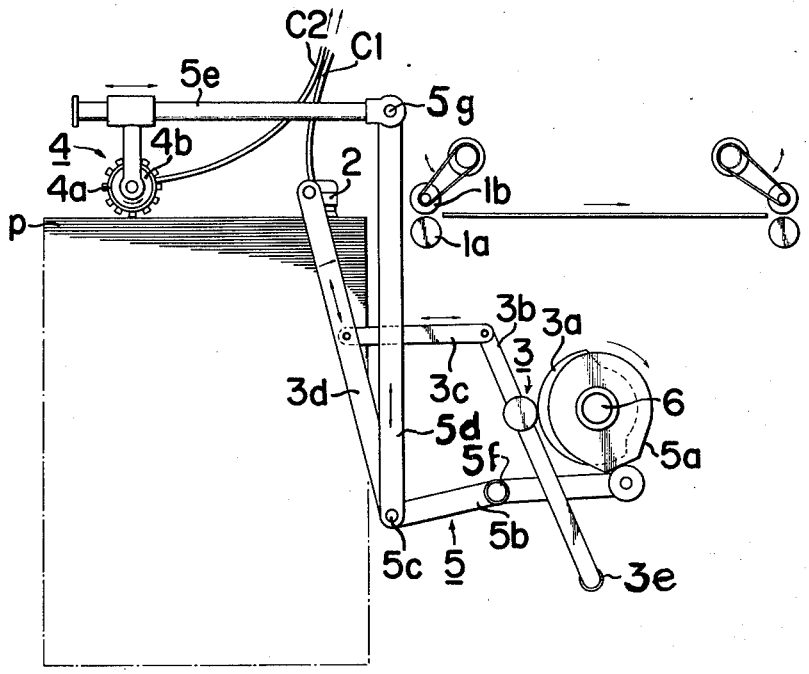
Figure 2:
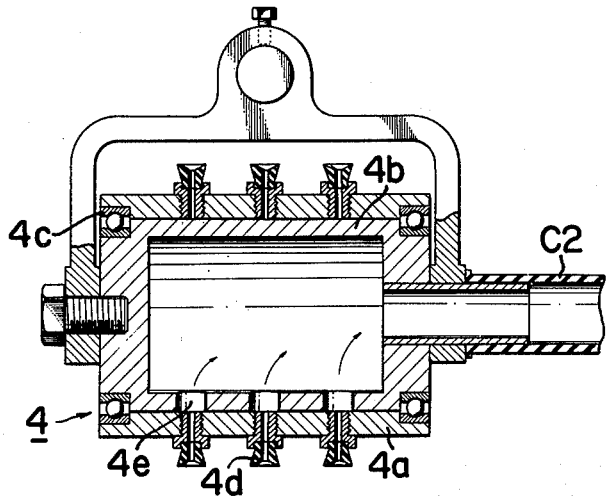

In order that the present invention may be more clearly understood, reference will now be made, by way of example, to the accompanying drawings in which:

FIG. 1 is a schematic side elevational view of a device according to the present invention; and FIG. 2 is a vertical sectional view of the rotary vacuum ring means shown in FIG. 1.

The device shown in the drawings is connected to a screen printing machine and consists mainly of two pairs of feed rollers 1a and 1b, a sucker 2, a rocking mechanism 3 for moving said sucker 2 forward and backward, a rotary vacuum ring means 4, and a lifting mechanism 5 for lifting said sucker 2 and said rotary vacuum ring means 4. A rocking cam 3a of said rocking mechanism 3 and a lifting cam **5*a* of said lifting mechanism 5 are operatively secured to a main shaft 6. The lifting cam 5*a* cooperates with one end of a lever 5*b* pivotally mounted at 5*f* to lift a rod 5*d* pivotally connected at a pin 5*c* to the other end of the lever 5*b*, while the rocking cam 3*a* cooperates with a lever 3*b* pivotally mounted at 3*e* and with a link 3*c* to rock a lever 3*d* which is pivotally connected at the lower end thereof by the pin 5*c* to the rod 5*d*. The sucker 2 is secured to the upper end of the lever 3*d* and is connected to a vacuum pump (not shown) through a flexible conduit C1 so that the object P to be printed is suctionally gripped by the sucker 2 and is fed into the rollers 1*a* and 1*b* as the lever 3*d* is moved forward toward them. The rotary vacuum ring means 4 which is connected to the vacuum pump through a flexible conduit C2 for suctionally gripping and moving the object to be printed is adjustably mounted on a supporting rod 5*e* so as to permit the adjustment of its position in forward and backward directions on the supporting rod 5*e* which is rigidly secured at 5*g* at one end thereof to the upper end of the rod 5*d* to form an inverted L-shaped lifting arm or suport for the lifting thereof. The rotary vacuum ring means 4 includes an outer ring or sleeve 4*a* rotatably supported on a stationary inner ring or hollow drum 4*b* by means of bearings 4*c* and a plurality of sucking members 4*d* such as rubber vacuum cups arranged in several rows on the outer periphery of said rotatable outer ring 4*a*. The inner ring 4*b* contains a vacuum chamber and has only at the lowest portion of the periphery thereof a plurality of openings 4*e* aligned with the rows of the sucking members 4*d* so that the inside chamber of the inner ring 4*b* communicates through the openings 4*e* with only the sucking members 4*d* located at the lowest position thereof and is connected through said conduit C2 to the vacuum pump. Thus, the outer ring 4*a* always suctionally grips the object P to be printed by means of the lowest sucking members 4*d* and rotates about the axis of the rotary vacuum ring means 4 to permit feeding the object progressively by the sucker. It will be understood that guiding means (not shown) may be provided for the lift rod 5*d*** to confine its motion to the vertical reciprocation indicated by the double-headed arrow thereon. Such guiding means has been omitted to simplify the drawing.

In operation, the main shaft 6 is driven to rotate the lifting cam **5*a*, whereupon the lever 5*b* lifts the rods 5*d* and 5*e* together with the lever 3*d*, and therefore the sucker 2 and the rotary vacuum ring means 4 are lifted at the same time to lift the object P to be printed parallelly to the stack of said objects P to be printed. At the same time, the rocking cam 3*a* is also rotated by the rotation of the main shaft 6 and actuates the lever 3*d* through the lever 3*b* and the link 3*c* to move the sucker 2 towards the feed rollers 1*a* and 1*b*, and thus the object P to be printed is fed to the feed rollers 1*a* ad 1*b*. Further rotations of the lifting cam 5*a* and the rocking cam 3*a* return the sucker 2 and the rotary vacuum ring means 4** to their original positions.

It will be seen from the above description, according to the present invention, a thick object such as print board, aluminum sheet or the like is automatically fed substantially parallelly to the feed rollers.

Many variations may be effcted without departing from the spirit and scope of the present invention. It is to be understood that the present invention comprehends these, together with other variations in details within the scope of the appended claims.

What is claimed is:

1. A device for lifting, sustaining and parallelly feeding objects to be printed in a printing machine, said device comprising a plurality of feed rollers, a support mounted for motion solely in a vertical direction, a sucker movably mounted on said support for horizontal motion relatively thereto toward and away from said feed rollers and adapted to be connected to a vacuum pump, a rocking mechanism for moving said sucker horizontally independently of the solely vertical motion of said support, a rotary vacuum ring means rotatably mounted on said support and having a rotatable sucking member adapted to be connected to said vacuum pump and lifted simultaneously with said sucker, and a lifting mechanism for moving said support solely in a vertical direction and consequently unitarily lifting said sucker and said rotary vacuum ring means, said rotary vacuum ring means being lifted together with said sucker by said vertically movable support and rotated in response to the pull thereon by an object to be printed while said object is sustained and fed parallelly to said feed rollers without bending of said object.

2. A device, according to claim 1, wherein said rotary vacuum ring means includes a hollow cylindrical drum with a vacuum chamber therein stationarily mounted on said support and having an end wall with an air outlet port therein adapted to be connected to said vacuum pump and a peripheral wall containing a stationary air inlet port, a sleeve freely and rotatably mounted on said drum in mating relationship therewith and containing a multiplicity of circumferentiallyspaced movable air inlet ports positioned to register successively with said stationary air inlet port in response to rotation of said rotatable sleeve, and a resilient sucking member mounted in each of said movable air inlet ports.

* * * * *